US008819962B2

(12) United States Patent
Candella

(10) Patent No.: US 8,819,962 B2
(45) Date of Patent: Sep. 2, 2014

(54) METHODS, APPARATUSES AND SYSTEMS FOR CONDITIONING SKIN

(75) Inventor: Michele Candella, Wallingford, CT (US)

(73) Assignee: Michele Lee Candella, Wolcott, CT (US)

( * ) Notice: Subject to any disclaimer, the term of this patent is extended or adjusted under 35 U.S.C. 154(b) by 412 days.

(21) Appl. No.: 13/292,378

(22) Filed: Nov. 9, 2011

(65) Prior Publication Data

US 2012/0116326 A1 May 10, 2012

Related U.S. Application Data

(60) Provisional application No. 61/412,102, filed on Nov. 10, 2010.

(51) Int. Cl.

| | |
|---|---|
| ***A43B 17/00*** | (2006.01) |
| ***A43B 13/38*** | (2006.01) |
| ***A43B 3/12*** | (2006.01) |
| ***A43B 13/22*** | (2006.01) |
| ***A43B 1/00*** | (2006.01) |
| ***A43B 3/10*** | (2006.01) |
| ***A43B 7/14*** | (2006.01) |

(52) U.S. Cl.

CPC ..... *A43B 3/108* (2013.01); *A43B 13/38* (2013.01); *A43B 3/128* (2013.01); *A43B 13/226* (2013.01); *A43B 17/00* (2013.01); *A43B 1/0045* (2013.01); *A43B 7/1455* (2013.01)

USPC ..... 36/43; 36/11.5; 36/140

(58) Field of Classification Search

USPC ..... 36/43, 44, 11.5, 140, 141

See application file for complete search history.

(56) References Cited

U.S. PATENT DOCUMENTS

| | | | | |
|---|---|---|---|---|
| 3,987,559 | A * | 10/1976 | Roberts | 36/95 |
| 4,257,176 | A * | 3/1981 | Hartung et al. | 36/44 |
| 5,930,916 | A * | 8/1999 | Connor | 36/11.5 |
| 5,992,055 | A * | 11/1999 | Connor | 36/43 |
| 6,532,689 | B1 * | 3/2003 | Jones, Jr. | 36/88 |
| 6,792,701 | B1 * | 9/2004 | Ruffini et al. | 36/98 |
| 7,055,265 | B1 * | 6/2006 | Bathum et al. | 36/3 B |
| 2003/0009138 | A1 | 1/2003 | Freeman et al. | |
| 2003/0171724 | A1 * | 9/2003 | Carter | 604/292 |
| 2004/0261290 | A1 * | 12/2004 | Wilson et al. | 36/11.5 |
| 2006/0059712 | A1 * | 3/2006 | Asham | 36/11.5 |
| 2006/0156583 | A1 | 7/2006 | Butash | |
| 2007/0094893 | A1 * | 5/2007 | Flores | 36/11.5 |
| 2007/0261265 | A1 | 11/2007 | Taylor-Buckner | |
| 2008/0034619 | A1 * | 2/2008 | Van Dyck | 36/3 B |
| 2011/0099850 | A1 * | 5/2011 | Van Dyck | 36/136 |

FOREIGN PATENT DOCUMENTS

| | | |
|---|---|---|
| EP | 1836911 A2 | 9/2007 |
| JP | 2000-110004 | 4/2000 |
| WO | WO 2007/027929 A3 | 3/2007 |

OTHER PUBLICATIONS

International Preliminary Report on Patentability issued on May 14, 2013 for PCT/US2011/059928 (5 pages).

* cited by examiner

*Primary Examiner* — Marie Bays

(57) ABSTRACT

Methods, apparatuses and systems are disclosed for conditioning a foot surface by contacting a foot surface with an article designed to contact foot surfaces for the purpose of abrading, moisturizing and otherwise conditioning a foot surface.

4 Claims, 3 Drawing Sheets

METHODS, APPARATUSES AND SYSTEMS FOR CONDITIONING SKIN

CROSS-REFERENCE

This application claims the benefit of the priority of Provisional U.S. Application No. 61/412,102 filed Nov. 10, 2010, entitled "Methods and Apparatuses for Conditioning Skin", and is incorporated by reference herein in its entirety.

FIELD OF THE INVENTION

The present invention is related, generally, to the field of therapeutic treatments for conditioning skin. More specifically, embodiments of the present invention are related to articles, systems and methods for treating and otherwise conditioning skin surfaces using interchangeable implements, including inserts in footwear, and footwear adapted to include such implements.

BACKGROUND

Many people, especially women, regularly invest significant time and money during visits to pedicurists and podiatrists, for example, to exfoliate, abrade, cleanse, moisturize, condition and otherwise treat the skin, especially on the bottoms of their feet. Such treatments include, for example, moisturizing treatments. These treatments promote the cleanliness, health, and comfort of the feet. Unfortunately, visits to the pedicurist for such treatments can be inconvenient, time-consuming, and expensive. An inexpensive, convenient, and efficient method for regularly treating and conditioning skin, especially skin on feet, that would obviate the need for such visits, would be highly beneficial.

BRIEF DESCRIPTION OF THE INVENTION

According to one embodiment, the present invention is directed to an article worn on a human foot comprising a first surface designed to come into contact with a sole of a foot. The first surface comprises a first texture, with the first texture preferably designed to condition a surface of the sole of the foot. The first texture is preferably selected to predictably condition the surface of the sole of the foot, preferably while the foot is engaged in a routine, repetitive motion, such as, for example, walking and/or running.

In addition, the present invention further contemplates that the apparatuses, systems and methods of the present invention could be effective even when the body is at rest. The contemplated conditioning includes, for example, abrading, massaging, moisturizing and other conditioning modes, etc.

While embodiments of the present invention contemplate effecting the conditioning, such as abrading etc., through contacting a foot or other skin surface with a surface having a first texture that is itself capable of abrading the foot surface, further embodiments of the present invention contemplate incorporating a medicament into the article designed to come into contact with a foot surface. Preferably, the medicament may be predictably released from the article to the foot surface, and may be, for example, time-released. The medicament preferably comprises a compound that is preferably selected from the group consisting of salicyclic acid, glycolic acid, tea tree oil, lemon grass extract, sesame seed oil, and herbal sands, etc., with tea tree oil being most preferred.

Still further embodiments of the present invention contemplate adapting the article to include medicaments such as, for example, creams and emollients designed to moisturize the foot surface through direct contact with the article. Such moisturizing compounds may be selected from the group consisting of cocoa butter, aloe, vitamin e lotion, tea tree oil, and multivitamin oil, etc., with multivitamin oil being most preferred.

According to another embodiment, the present invention is directed to a foot conditioning system comprising an article worn on a foot, with the article comprising a removable first insert. The first insert comprises a surface designed to come into contact with a foot surface, and comprising at least one texture designed to predictably treat and/or condition a foot surface. The article further comprises a removable second insert having a second surface designed to come into contact with a foot surface, and comprising at least one texture designed to predictably treat and/or condition a foot surface.

In another embodiment, the present invention is directed to a foot conditioning system comprising an article worn on a foot comprising a removable insert comprising a first surface designed to come into contact with a foot surface, and a first texture designed to predictably provide a first treatment to a foot surface. The article further comprises a second surface comprising a second texture designed to predictably provide a second treatment to a foot surface, with the second treatment differing from the first treatment.

In a still further embodiment, the present invention is directed to a method for conditioning a surface of a foot comprising the steps of providing a foot to be conditioned, providing a first article designed to come into contact with a foot, comprising a first surface designed to come into contact with a foot, and comprising a first texture designed to treat and/or condition a surface of a foot. The first surface is provided to a foot surface. The first article is removed and replaced with a second article designed to come into contact with a foot, comprising a second surface designed to come into contact with a foot, and comprising a second texture designed to treat and/or condition a surface of the foot, and providing the second surface to a surface of a foot.

In yet another embodiment, the present invention is further directed to a method for conditioning a foot surface comprising the steps of providing a foot having a foot surface, and providing an article designed to contact a foot comprising a removable insert having a surface designed to come into contact with the foot surface comprising at least one texture designed to predictably and substantially simultaneously treat a foot surface to effect a first treatment while engaging in a repetitive motion selected from the group consisting of running and walking, and bringing the foot into intimate contact with the article. In a preferred embodiment, the removable insert comprises a second texture different from the first texture, with the second texture designed to predictably and substantially simultaneously treat a foot surface to effect a second treatment different from the first treatment while engaging in a repetitive motion selected from the group consisting of running and walking.

The articles designed to contact the foot surface are selected from the group consisting of shoes, boots, sandals, running footwear, foot gloves, feet pajamas, slippers and socks, etc. Further embodiments of the present invention contemplate interchanging components within the article for contacting a foot surface, such that a set of components, for example, "inserts" may be removable and oriented within the article to first treat and/or condition a foot surface in a first mode (for example, exfoliating or abrading a foot surface), and then treat and/or condition a foot surface in a second mode (for example, moisturizing or otherwise conditioning a foot surface).

Similarly, embodiments of the present invention are directed to methods for conditioning a skin surface comprising the steps of providing a foot to be conditioned and providing an article designed to come into contact with a foot. The article comprising a first surface is designed to come into contact with a sole of a foot, with the first surface comprising a first texture, and the first texture designed to condition a surface of the sole of the foot.

BRIEF DESCRIPTION OF THE DRAWINGS

Having provided an outline of embodiments of the present invention, examples are now presented and will be described with respect to the accompanying drawings. It will be appreciated, however, that many variations to the presented examples and many other examples of the application of the invention are possible without departing from the scope of the invention set forth in the following claims.

DETAILED DESCRIPTION OF THE INVENTION

Figure 1:
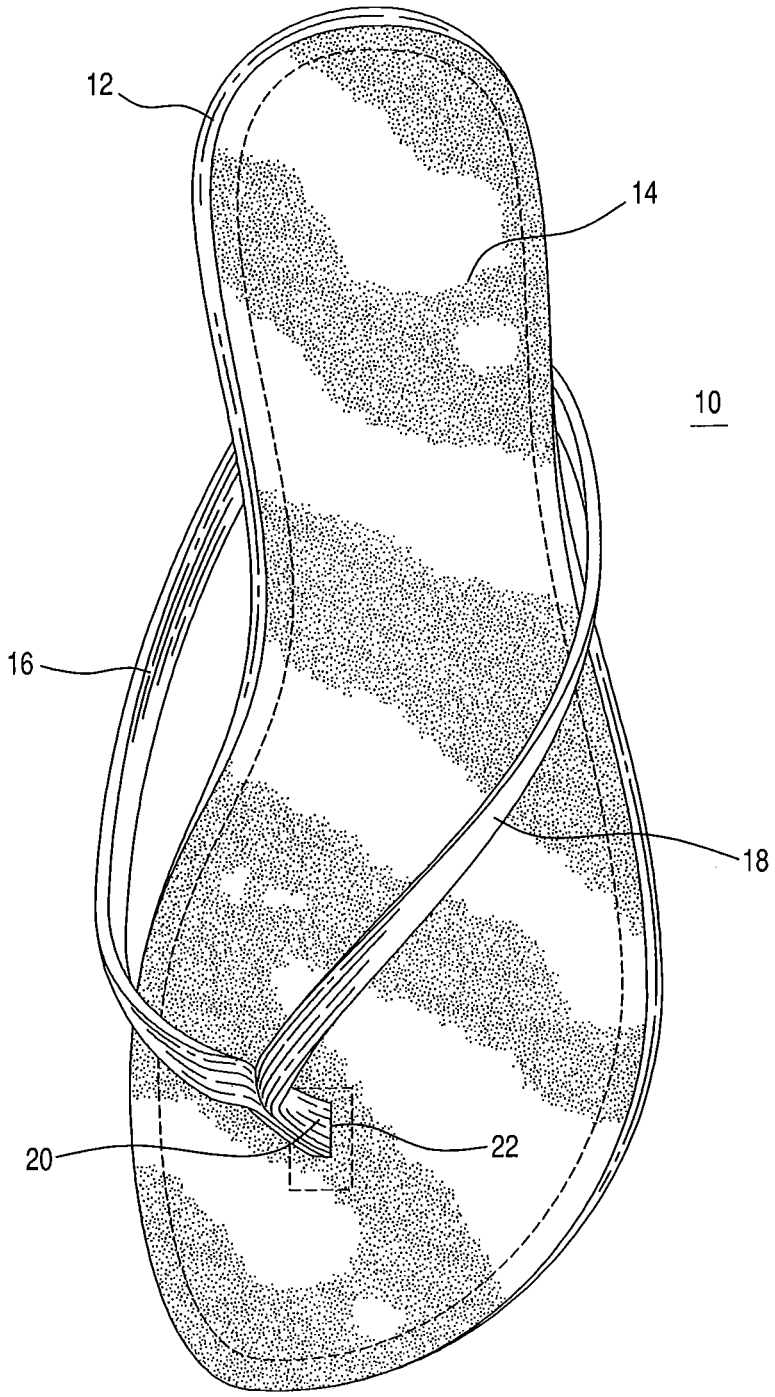
FIG. 1 is top view of the present invention in the embodiment of a flip-flop sandal.

While the present invention contemplates any article that can be brought into contact with a foot, (such as, for example, shoes, boots, sandals, running footwear, foot gloves, slippers and socks, etc.), it is understood that one commonly-known and useful sandal that may be particularly well-suited for embodiments of the present invention is the sandal known as a "flip-flop". A "flip-flop" is an article of footwear that consists of a flat, foot-shaped base pad that is worn on the bottom of the foot. According to one embodiment, in the area designed to be directly under the wearer's first two toes, a post protrudes vertically from the base pad. A strap is attached to the top of the post. The ends of the strap are attached to the sides of the base, making it possible to hold the flip-flop to the wearer's foot as the wearer walks. Flip-flops may be adapted according to embodiments of the present invention to have a predetermined texture oriented on the flip-flop upper surface that, for example, would come into contact with the sole of a foot.

Alternatively, the articles, such as flip-flops, may be constructed according to the embodiments of the present invention to allow for interchangeable inserts of varying textures to be inserted therein or otherwise attached thereto, giving great flexibility to conditioning and skin treatment options. Such inserts, or "attachment pads" may be selected with varying textures, including varying degrees of coarseness, depending only on the desired degree of skin exfoliating and abrading that is to be conducted. The inserts or attachment pads may be attached or otherwise oriented in place in a predetermined orientation using adhesives that may or may not be easily releasable, or may use another attachment means such as, for example, strips of cooperating Velcro, etc.

According to one contemplated embodiment, to assemble the article of the invention, Velcro® may be affixed by any acceptable means as would be readily understood (such as, for example, with glue or other adhesive, etc.) to the top surface of the base of each flip-flop. Velcro® is also affixed (with glue or other adhesive, etc.) to the bottom of each attachment pad. Each attachment pad is dimensioned as desired, and according to one embodiment, may closely approximate the same size and shape as one of the corresponding flip-flops, for example, with some attachment pads in the shape of a left foot flip-flop base and some attachment pads in the shape of a right foot flip-flop base, etc.

According to one preferred embodiment of the present invention, a slit is oriented in the toe area of each attachment pad. This enables the user to place the attachment pad over the base pad of the corresponding flip-flop, fitting such attachment pad around the post protruding from the base of the flip-flop. The Velcro® on the attachment pad and on the base pad serves to fasten the attachment pad to the base pad and to enable the easy removal of the attachment pad from the base pad. In still further embodiments of the present invention, as shown in the accompanying Figures, the attachment pad has dimensions substantially approximating the dimension of the base. The strap may detach from the toe area of the flip-flop to accommodate the placement of the attachment pad to the base. The attachment pad has an opening extending through the attachment pad that substantially aligns with an opening in the base that substantially matches and otherwise coincides with the opening found in the attachment pad. In this way, the strap may be inserted through the aligned openings in the attachment pad and the base. As would be readily understood by those skilled in the field of footware, the strap and the base may be made from any material that is durable and preferably pliable, such as, for example, leather, cloth, plastic, rubber, combinations thereof, etc. such that the strap has a terminal end that has a slightly larger dimension than the aligned openings in the attachment pad and the base. In this way, the terminal end of the strap can be easily pulled through the aligned openings and remain in place during use.

Figure 2:
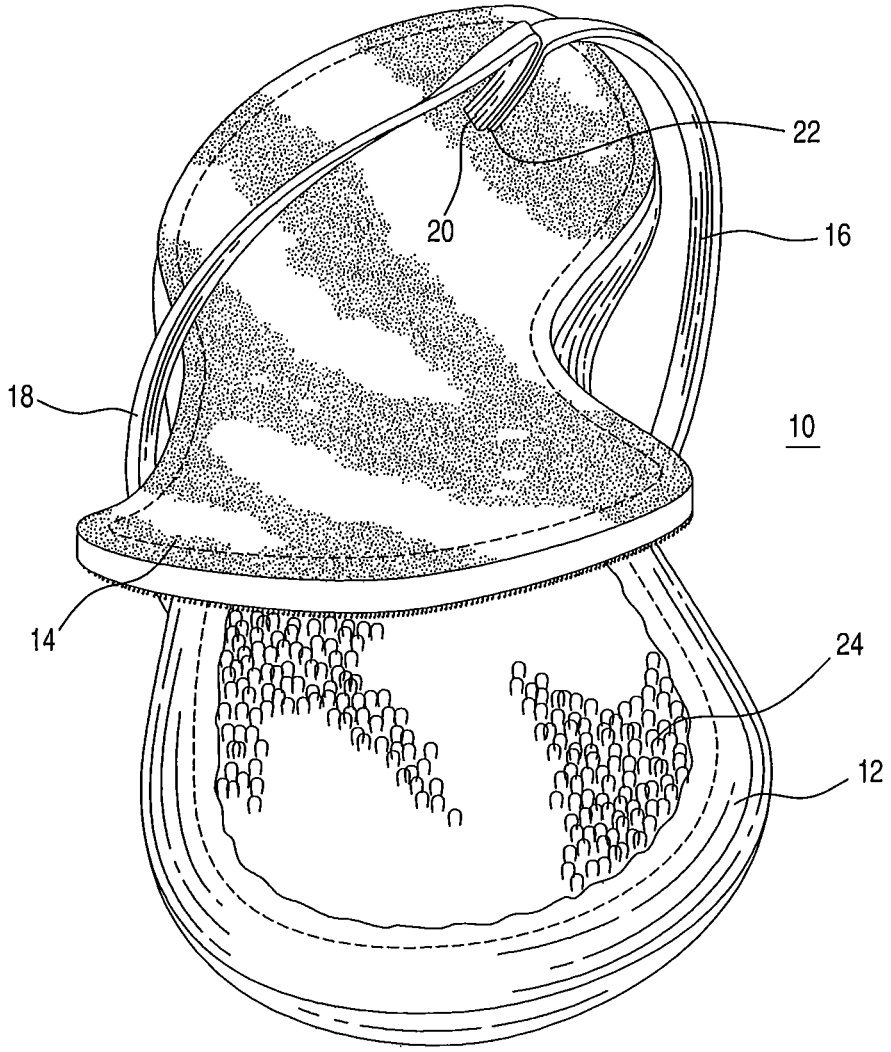
FIG. 2 is perspective view of the sandal shown in FIG. 1 showing an interchangeable attachment pad attached to the base.
Figure 3A:
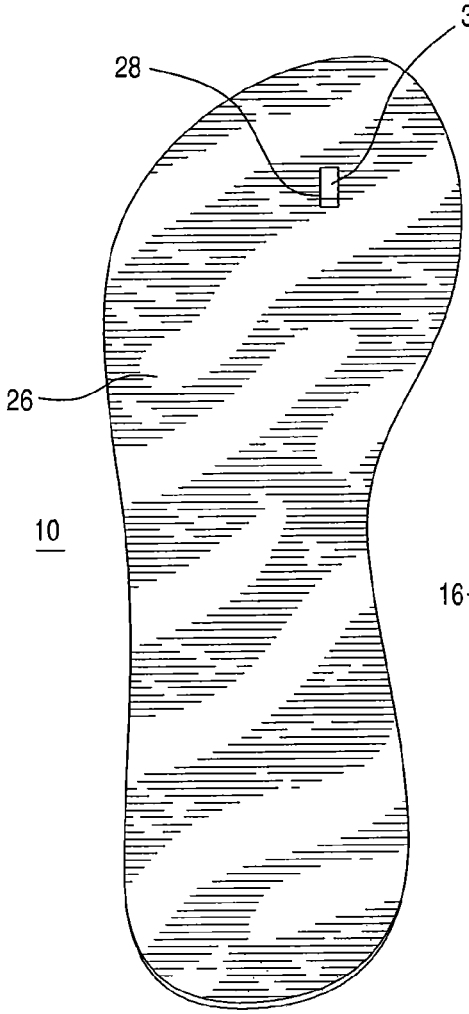
FIG. 3A shows a bottom view of the sandal shown in FIG. 1.
Figure 3B:
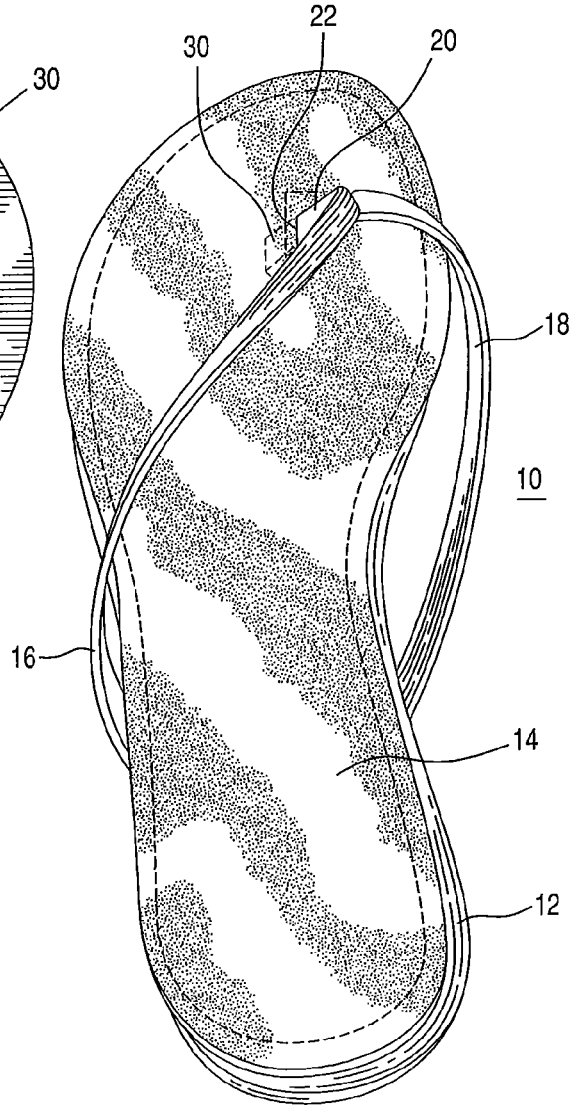
FIG. 3B shows an alternate view of the sandal shown in FIG. 1.

As shown in FIG. 1, a flip-flop 10 comprises a base 12 attached to an attachment pad 14. Straps 16, 18 attach to the side of base 12 and come together at post 20 protruding through attachment slot 22 in attachment pad 14. FIG. 2 shows a perspective view of the flip-flop 10 shown in FIG. 1. Attachment pad 14 is shown lifted from base 12. The attachment pad 14 is held in place via Velcro®, some of which is shown 24 in base 12. FIG. 3A shows the bottom 26 of flip-flop 10, showing a base slot 28 and the base 30 of the strap post 20 that is retained in the base slot 28. It is understood and preferred that attachment slot 20 and base slot 28 are substantially aligned to allow the passage of post 20 therethrough.

According to further preferred embodiments of the present invention, the attachment pads may be preferably divided into categories, such as, for example, pads," has been replaced with the phrase "cleansing pads, exfoliating pads, abrading pads, moisturizing pads, conditioning pads,". etc. Each category includes attachment pads designed to fit over "left" flip-flop bases and attachment pads designed to fit over "right" flip-flop bases.

In one embodiment, the top of each exfoliating pad preferably comprises an abrasive surface that is suitable, for example, for exfoliating the skin on the bottom of a foot. According to one embodiment, the wearer attaches exfoliating pads to each flip-flop base, and places the flip-flops on his or her feet. The walking motion of the wearer in the flip-flops assists in causing the wearer's feet to rub against the abrasive surfaces of the exfoliating pads. Without being bound to any particular theory, it is believed that this motion produces a frictional force that assists in exfoliating the skin on the bottom of the wearer's feet. According to further embodiments, the wearer continues to wear and walk in the flip-flops until the skin on the bottom of his or her feet has been exfoliated to the wearer's satisfaction. Embodiments of the present invention further contemplate first providing a cleansing pad with a compound that may include, a safe and efficacious amount of, for example, salicylic acid, glycolic acid, tea tree oil, lemon grass extract, sesame seed oil, and herbal sands, etc., with tea tree oil being particularly preferred. In one embodiment, when the desired level of treatment has occurred, the wearer then removes the exfoliating pads from the flip-flops.

According to further embodiments, a surface of each treatment pad is made of cloth or any other soft and cushioned, natural or synthetic, woven or non-woven fabric or other material that is preferably suitable for retaining or comprising a useful compound such as, for example, a moisturizer or other lotion, preferably without excessive absorption or release. After removing the exfoliating pads from the flip-flops, the wearer then inserts and otherwise attaches a treatment pad to each flip-flop base. The treatment pad may already be impregnated with a desired moisturizer or lotion, etc., or the wearer may apply a liquid moisturizer or other lotion of choice, etc., to the top surface of each treatment pad, and then place the flip-flops on his or her feet. The walking or running motion of the wearer transfers a desired amount of the moisturizer or other conditioning compound to the wearer's feet. The moisturizer or lotion may include, for example, cocoa butter, aloe, vitamin e lotion, tea tree oil, and multivitamin oil, etc., with multivitamin oil being particularly preferred. The wearer continues to walk or run in the flip-flops until his or her feet have satisfactorily absorbed the moisturizer or other lotion. The wearer then removes the treatment pads from the base pads.

The comfort pads preferably are made of wool or other soft woven or non-woven fabric. Comfort pads may come in various colors, designs, and styles without limitation. They may also come in varying degrees of softness. According to further embodiments of the present invention, after the wearer has removed the treatment pads from the flip-flops, the wearer attaches a comfort pad to the base of each flip-flop. The wearer may then wear and walk in the flip-flops until the next time the wearer wishes to exfoliate and/or otherwise treat his or her feet, or until the wearer wishes to replace the comfort pads with different comfort pads.

Though not illustrated, embodiments of the present invention contemplate a further arrangement wherein an insert is capable of providing multiple textures through different regions of the insert for the purpose of substantially simultaneously providing different treatment and/or conditioning options to differing regions of the foot. For example, one portion of the foot may require abrading while another portion of the foot does not, but instead requires only moisturizing. In this instance, embodiments of the present invention provide an insert with multiple varied textures to effect the desired treatment to the desired portion of the foot.

Still further, according to embodiments of the present invention, the insert may have one or more textures designed to effect treatment option to regions of the foot. In addition, the inserts are able to predictable release desired medicaments for varied treatment to varied regions of the foot. The inserts may comprise discrete reservoirs containing medicaments for abrading, moisturizing various regions of the foot substantially simultaneously and be able to selectively abrade some regions of the foot, while moisturizing other regions of the foot without the need to remove an abrading insert and then replace it with a, for example, a moisturizing insert, etc. As would be readily understood by one skilled in the field, embodiments of the present invention further contemplate inserts comprising medicaments selected to offer a variety of treatments to regions of a foot substantially simultaneously. In other words, the inserts of the present invention may comprise textures and/or be impregnated with medicaments, or have medicaments applied to a surface of an insert or to a reservoir for predictable release, that provide a multiplicity of treatments to a foot surface such as, for example, exfoliating, abrading, moisturizing, conditioning, etc., substantially simultaneously Although the invention has been described in a preferred form with a certain degree of particularity, it is understood that the present invention of the preferred form has been made only by way of example, and numerous changes in the details of construction and combination and arrangement of parts and steps may be resorted to without departing from the spirit and scope of the invention as hereinafter claimed. It is intended that the patent shall cover, by suitable expression in the appended claims, whatever features of patentable novelty exists in the invention disclosed.

I claim:

1. A method for conditioning a foot comprising:

providing a foot having a foot surface, providing an article of footwear with a plurality of removable inserts having surfaces designed to come into contact with the foot surface, the plurality of removable inserts having different surfaces comprising at least:

a first removable insert having a first surface comprising means for cleansing the foot surface, a second removable insert having a second surface comprising means for exfoliating the foot surface, a third removable insert having a third surface comprising means for moisturizing the foot surface, the method comprising the steps of:

wearing said footwear with said first removable insert attached to cleanse the foot, removing the first removable insert and attaching the second removable insert, wearing said footwear with said second removable insert attached to exfoliate the foot, removing the second removable insert and attaching the third removable insert, wearing said footwear with said third removable insert to moisturize the foot.

2. The method of claim 1 wherein said means for cleansing the foot surface comprises a medicament selected from the group consisting of salicylic acid, glycolic acid, tea tree oil, lemon grass extract, sesame see oil, and herbal sands.

3. A system for conditioning a foot comprising:

an article of footwear with a plurality of removable inserts having surfaces designed to come into contact with the foot surface, the plurality of removable inserts having different surfaces comprising at least:

a first removable insert having a first surface comprising means for cleansing the foot surface, a second removable insert having a second surface comprising means for exfoliating the foot surface, a third removable insert having a third surface comprising means for moisturizing the foot surface.

4. The system of claim 3 wherein said means for cleansing the foot surface comprises a medicament selected from the group consisting of salicylic acid, glycolic acid, tea tree oil, lemon grass extract, sesame see oil, and herbal sands.

* * * * *